US005967421A

United States Patent [19]

Wang

[11] Patent Number: 5,967,421

[45] Date of Patent: Oct. 19, 1999

[54] WATER AMOUNT CONTROLLING SWITCH STRUCTURE OF WATER INJECTION GUN

[75] Inventor: King-Yuan Wang, Changhua Hsien, Taiwan

[73] Assignee: Yuan Mei Corp., Changhua Hsien, Taiwan

[21] Appl. No.: 09/074,389

[22] Filed: May 8, 1998

[51] Int. Cl.[6] ..... B05B 7/02

[52] U.S. Cl. ..... 239/526

[58] Field of Search ..... 239/525, 526

[56] References Cited

U.S. PATENT DOCUMENTS

| | | | |
|---|---|---|---|
| 4,776,517 | 10/1988 | Heren | 239/526 |
| 5,176,327 | 1/1993 | Petersen et al. | 239/526 |
| 5,205,540 | 4/1993 | Clapp | 239/526 |
| 5,303,868 | 4/1994 | Kroll | 239/526 |
| 5,323,968 | 6/1994 | Kingston et al. | 239/526 |
| 5,662,273 | 9/1997 | Chih | 239/526 |
| 5,662,276 | 9/1997 | Ko | 239/526 |

*Primary Examiner*—Andres Kashnikow
*Assistant Examiner*—Dinh Q. Nguyen
*Attorney, Agent, or Firm*—Bacon & Thomas, PLLC

[57] ABSTRACT

A water amount controlling switch structure of water injection gun, including a gun housing, a controlling pin, a water sealing gasket, a locating ring, an adjustment pin, a trigger, a push button, a pad member, a water sealing ring and three springs. The trigger is U-shaped and pivotally connected with an opening of a chamber of the gun housing. A lower portion of inner side of a middle board of the trigger is disposed with a projecting conic head pushing post. An upper section of the middle board is disposed with a push button notch. A lower edge of the notch is formed with a supporting slope face. The push button is received in the notch. An upper section of inner side of the push button is disposed with a hollow fitting post. A bottom edge of the push button is formed with a micro-adjustment slope face leaning against and engaging with the supporting slope face of the notch of the trigger. An end of the micro-adjustment slope face of the push button is disposed with a short horizontal section and a vertical engaging edge connected with the horizontal section. By means of the engagement between the supporting slope face of the trigger and the micro-adjustment slope face of the push button, the trigger can be freely pressed inward and located to micro-adjust the water amount and by means of pressing the push button, the trigger is restored to its home position to shut off the water.

2 Claims, 4 Drawing Sheets

WATER AMOUNT CONTROLLING SWITCH STRUCTURE OF WATER INJECTION GUN

BACKGROUND OF THE INVENTION

The present invention relates to a water amount controlling switch structure of water injection gun, which can easily and quickly micro-adjust the water amount or shut off the water as necessary.

In the conventional water injection gun, the water flow is controlled by a front trigger type controlling switch. Such controlling switch can only keep a maximum water amount or shut off the water, while failing to micro-adjust water amount as necessary. This often leads to inconvenience in use of the water injection gun.

SUMMARY OF THE INVENTION

It is therefore a primary object of the present invention to provide a water amount controlling switch structure of water injection gun, which is able to micro-adjust the water amount as necessary.

It is a further object of the present invention to provide the above water amount controlling switch structure in which the micro-adjustment and shutting off of the water flow can be easily performed only by directly pressing the trigger or the push button.

The present invention can be best understood through the following description and accompanying drawings, wherein:

DETAILED DESCRIPTION OF THE PREFERRED EMBODIMENT

Figure 1:
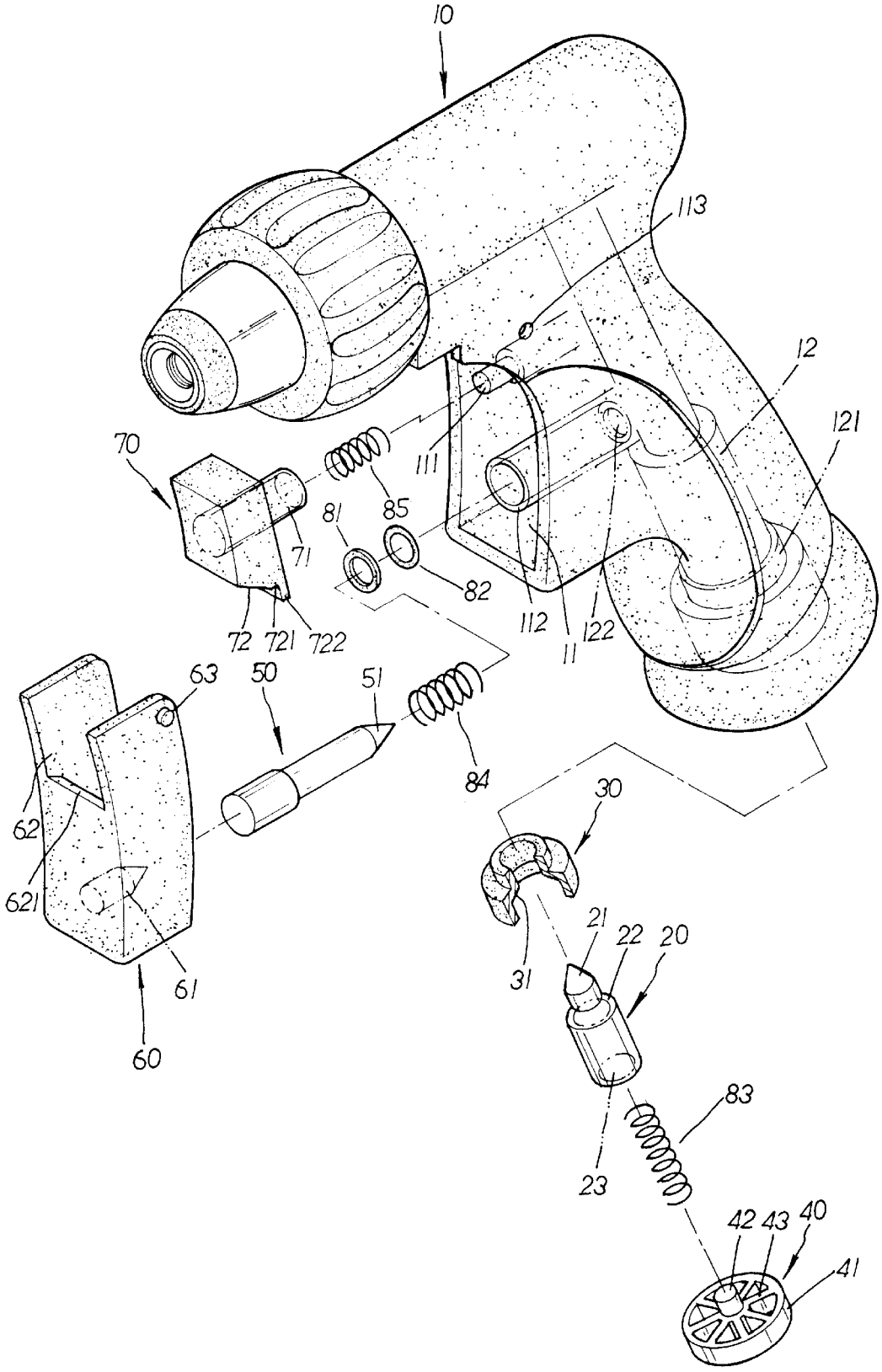
FIG. 1 is a perspective exploded view of the present invention.

Please refer to FIG. 1. The present invention includes a gun housing 10, a controlling pin 20, a water sealing gasket 30, a locating ring 40, an adjustment pin 50, a trigger 60, a push button 70, a pad member 81, a water sealing ring 82 and three springs 83, 84, 85. The gun housing 10 has a grip an inner side of which is formed with a chamber 11. An upper portion of the bottom of the chamber 11 is disposed with a stepped post 111. A lower portion of the bottom of the chamber is disposed with a hollow post 112. An upper end portion of the lateral wall of the chamber is formed with a rivet hole 113. The grip is formed with an internal three-stepped water way 12. A lower end portion of the middle diameter section of the water way 12 is formed with an insertion groove 121. A lower portion of the small diameter section of the water way is formed with a pin hole 122 communicating with the hollow post 112 of the chamber 11. The diameter of the pin hole 122 is smaller than inner diameter of the hollow post 112. The controlling pin 20 is two-stepped. A small diameter section thereof is formed with a conic head 21 at end portion. The step section of the controlling pin is disposed with an annular engaging slope face 22. The end face of the large diameter portion of the controlling pin is formed with a spring fitting cavity 23. The water sealing gasket 30 is two-stepped. The inner step portion thereof is disposed with a water sealing slope face 31. The locating ring 40 is formed by a ring section 41 and stepped fitting post 42. A lower large diameter portion thereof is (connected with the ring section 41 by radial ribs 43. The adjustment pin 50 is also two-stepped. The small diameter thereof is formed with a conic head 51 at end portion. The trigger 60 is a U-shaped member. A middle board thereof is disposed with a conic head pushing post 61 projecting from lower portion of inner side. An upper portion of the middle board is formed with a push button notch 62. A lower edge of the push button notch 62 is formed with a supporting slope face 621. The rear corner of upper end of each lateral wall of the trigger is disposed with an outward extending boss 63. An upper portion of inner side of the push button 70 is disposed with a projecting hollow fitting post 71. the bottom of the push button is disposed with a micro-adjustment slope face 72. The end of the micro-adjustment slope face 72 is disposed with a short horizontal section 721 and a vertical engaging edge 722 connecting therewith.

Figure 2:
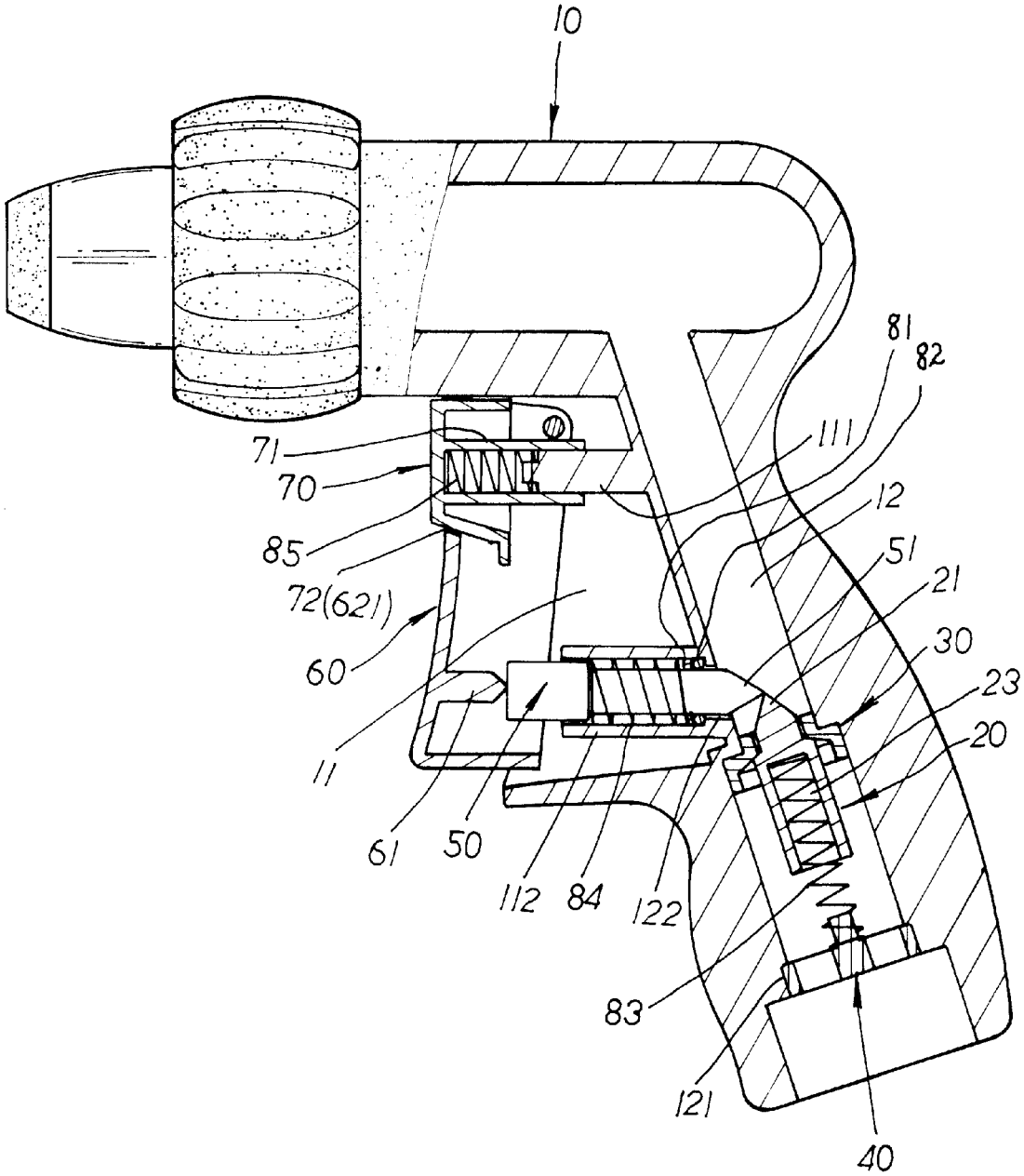
FIG. 2 is a sectional assembled view of the present invention.

Please refer to FIG. 2. When assembled, the water sealing gasket 30 is fitted into the water way 12 of the gun housing 10 to tightly engage with the step between the small and middle diameter portions. One end portion of the spring 83 is fitted onto the small diameter portion of the stepped fitting post 42 of the locating ring 40. The other end portion of the spring 83 is fitted into the spring fitting cavity 23 of the controlling pin 20. Then the locating ring 40 is tightly fitted into the insertion groove 121 of the water way 12. At this time, the engaging slope face 22 of the controlling pin 20 is resiliently forced by the compression spring 83 to abut against the water sealing slope face 31 of the water sealing gasket 30. The conic head 21. of the controlling pin 20 extends through the water sealing gasket 30 into the small diameter portion of the water way 12 of the gun housing 10. The spring 84, pad member 81 and water sealing ring 82 are sequentially fitted onto the small diameter portion of the adjustment pin 50. The adjustment pin 50 is fitted into the hollow post 112 of the chamber 11 of the gun housing 10 with the water sealing ring 82 and the pad member 81 engaged with bottom face of the hollow post 112 and with the spring 84 resiliently compressed between the step of the adjustment pin 50 and the pad member 81. The conic head 51 of the adjustment pin 50 extends through the pin hole 122 of the gun housing 10 into the small diameter portion of the water way 12 to abut against the tip of the conic head 21 of the controlling pin 20. One end portion of the spring 85 is fitted around the small diameter portion of the stepped post 111 of the chamber 11. The hollow fitting post 71 of the push button 70 is fitted with the spring 85 and the large diameter portion of the stepped post 111. Then 1the trigger 60 is fitted into the chamber 11 of the gun housing 10. The bosses 63 of the trigger 60 are resiliently pivotally inserted in the rivet holes 113 of the gun housing 10. At this time, the tip of the conic head pushing post 61 of the trigger 60 abuts against the end face of the adjustment pin 50. The push button 70 is received in the notch 62 of the trigger 60 with the micro-adjustment slope face 72 of the push button 70 leaning against the supporting slope face 621 of the notch 62.

Figure 3:
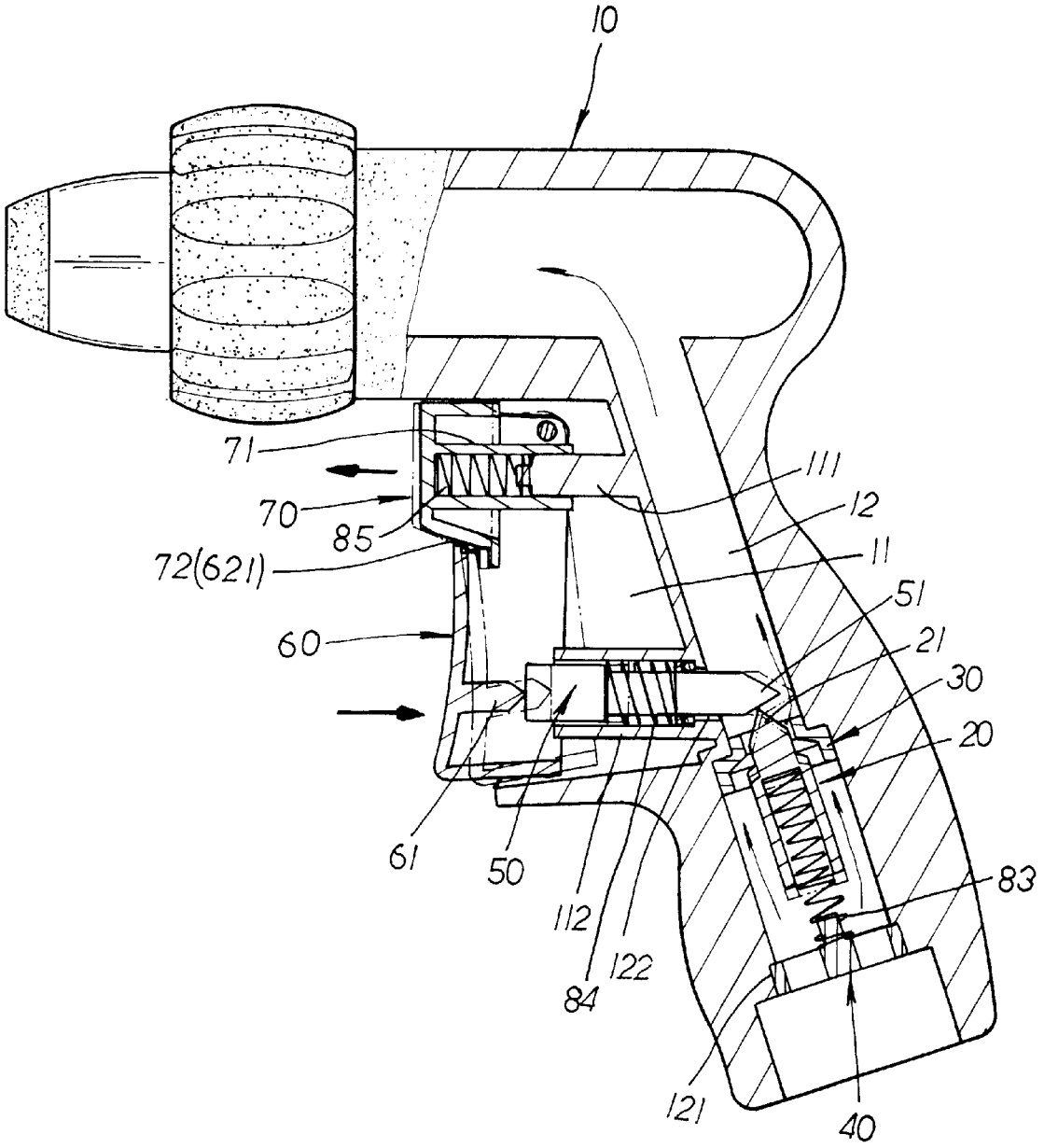
FIG. 3 is a view according to FIG. 2, showing the micro-adjustment operation of the present invention.

Please refer to FIG. 3. When operated, the trigger 60 is slowly pressed toward the chamber 11 of the gun housing 10, whereby the supporting slope face 621 of the trigger 60 is inward pivoted. Accordingly, the push button 70 is resiliently moved outward by the spring 85, while the micro-adjustment slope face 72 of the push button 70 is kept leaning against the supporting slope face 621 of the trigger

60. Simultaneously, the conic pushing post 61 of the trigger 60 inward pushes the adjustment pin 50 and compresses the spring 84. Further, the conic face of the conic head 51 of the adjustment pin 50 downward depresses the tip of the conic head 21 of the controlling pin 20, making the engaging slope face 22 of the controlling pin 20 separate from the water sealing slope face 31 of the water sealing gasket 30. Therefore, the water can flow through the locating ring 40 and the gap between engaging slope face 22 and the water sealing slope face 31 to be discharged from the gun housing. When the water flow reaches the necessary amount, the trigger 60 is released. At this time, on one hand the conic pushing post 61 of the trigger 60. is resiliently pushed by the spring 84 and on the other hand the supporting slope face 621 of the push button is leant against and engaged with the micro-adjustment slope face 72 of the push button 70. Therefore, the trigger 60 is located and makes the injection gun discharge water at constant amount.

Figure 4:
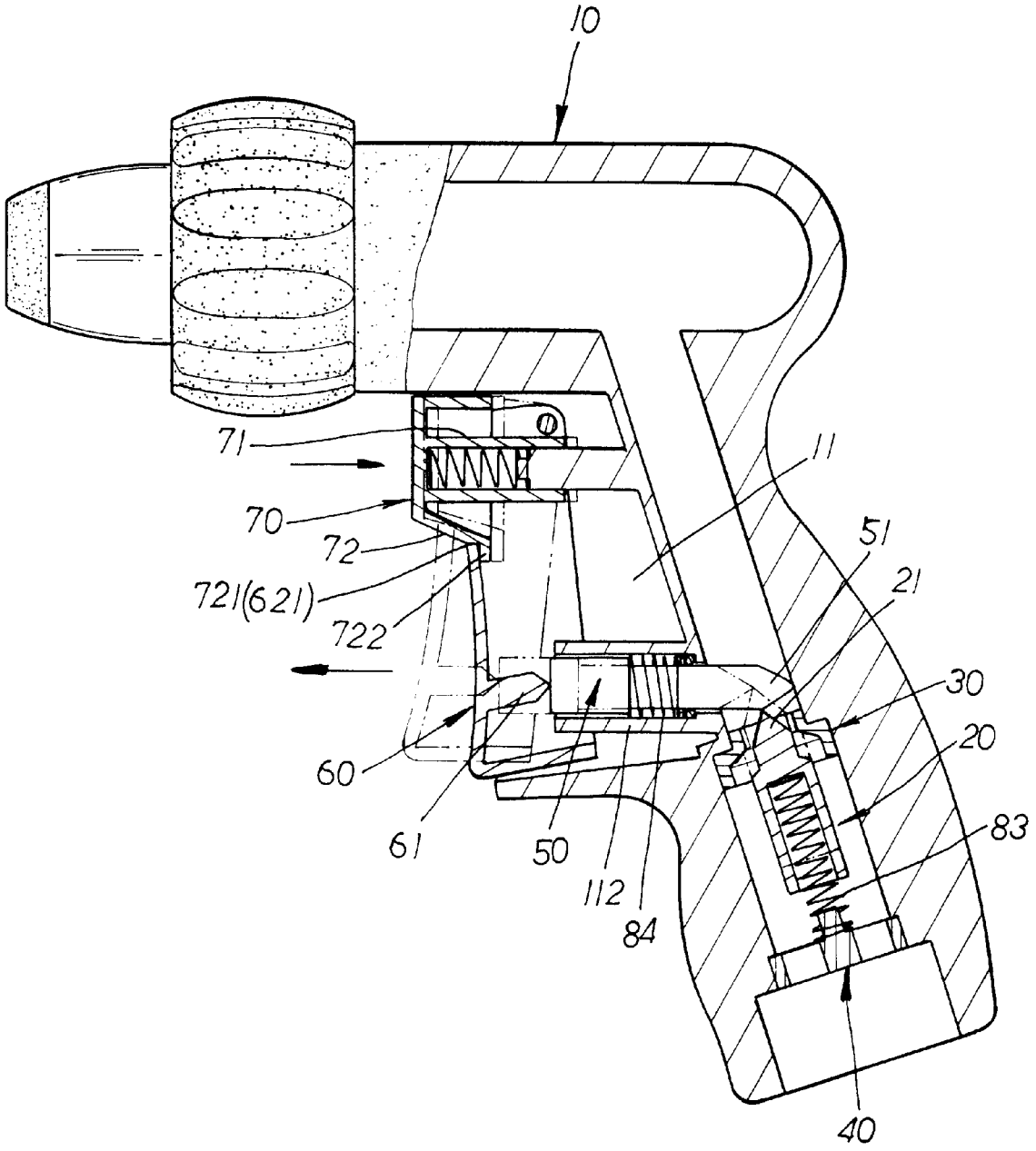
FIG. 4 is a view according to FIG. 2, showing the shutting off operation of the present invention.

Please refer to FIG. 4. When it is desired to keep a greatest water amount, the trigger 60 is pressed toward the chamber 11 to the bottom. At this time, the support slope face 621 of the trigger 60 is leant against and engaged with the horizontal section 721 of the micro-adjustment slope face 72 of the push button 70 and the engaging edge 722 of the micro-adjustment slope face 72 is engaged with an inner side of lower edge of the notch 62 of the trigger 60. Also, the large diameter portion of the conic head 51 of the adjustment pin 50 presses the tip of the conic head 21 of the controlling pin 20. At this time, the engaging slope face 22 of the controlling pin 20 is maximum separated from the water sealing slope face 31 of the water sealing gasket 30 so as to keep a maximum water amount. Reversely, when it is desired to shut off the water, the push button 70 is pressed toward the chamber 11, whereby a gap is formed between the micro-adjustment slope face 72 and the supporting slope face 621. At this time, the trigger 60 is outward pivoted by the spring 84 to keep the supporting slope face 621 leaning against the micro-adjustment slope face 72. Accordingly, the conic pushing post 61 of the trigger 60 is moved outward and the adjustment pin 50 is resiliently outward restored to its home position by the spring 84. Also, the controlling pin 20 is resiliently moved upward to its home position by the spring 83, whereby the engaging slope face 22 is engaged with the water sealing slope face 31 to shut off the water.

According to the above arrangement, the present invention has the following advantages:

1. The water amount can be micro-adjusted as necessary.

2. The micro-adjustment and shutting off of the water flow can be easily performed.

The above description and accompanying drawings are only used to illustrate one embodiment of the present invention. Any modification or variation derived from the embodiment should fall within the scope of the present invention.

What is claimed is:

1. A water amount controlling switch structure of water injection gun, the injection gun having a gun housing, the gun housing having a grip in which a three-stepped water way is formed, a water sealing gasket being fitted with a step portion between a small and a middle diameter portions of the water way, a controlling pin being fitted in the water sealing gasket and resiliently upward pushed by a spring, an inner side of the grip being formed with a chamber, a stepped post and a hollow post being respectively disposed on upper and lower sections of a bottom of the chamber, an adjustment pin being fitted in the hollow post and outward pushed by a spring, a conic face of a conic head of the adjustment pin downward pressing a tip of a conic head of the controlling pin so as to change the gap between an engaging slope face of the controlling pin and a water sealing slope face of the water sealing gasket and thus control water amount, said controlling switch structure being characterized in that a U-shaped trigger is pivotally connected with an opening of the chamber of the gun housing, a lower portion of inner side of a middle board of the trigger being disposed with a projecting conic head pushing post for abutting against an end face of the adjustment pin, an upper section of the middle board being disposed with a push button notch, a lower edge of the notch being formed with a supporting slope face, a push button being received in the notch, an upper section of inner side of the push button being disposed with a hollow fitting post, the hollow fitting post being resiliently pushed by a spring fitted on the stepped post of the chamber, a bottom edge of the push button being formed with a micro-adjustment slope face leaning against and engaging with the supporting slope face of the notch of the trigger, whereby by means of the engagement between the supporting slope face of the trigger and the micro-adjustment slope face of the push button, the trigger can be freely pressed inward and located to micro-adjust the water amount and by means of pressing the push button, the trigger is restored to its home position to shut off the water.

2. A water amount controlling switch structure as claimed in claim 1, wherein an end of the micro-adjustment slope face of the push button is disposed with a short horizontal section and a vertical engaging edge connected with the horizontal section.

* * * * *